United States Patent [19]

Messenger

[11] Patent Number: 4,489,784

[45] Date of Patent: Dec. 25, 1984

[54] WELL CONTROL METHOD USING LOW-MELTING ALLOY METALS

[76] Inventor: Joseph U. Messenger, 2906 Gladiolus La., Dallas, Tex. 75233

[21] Appl. No.: 463,224

[22] Filed: Feb. 2, 1983

[51] Int. Cl.[3] ..... E21B 33/13

[52] U.S. Cl. ..... 166/288; 166/292; 166/302; 137/1

[58] Field of Search ..... 166/363, 364, 302, 277, 166/192, 90, 376, 292, 288, 284; 175/72, 226; 137/1, 13, 334, 340, 341; 277/1

[56] References Cited

U.S. PATENT DOCUMENTS

| | | | |
|---|---|---|---|
| 1,631,419 | 6/1927 | Kinley | 166/192 |
| 2,341,572 | 2/1944 | Reed | 175/72 |
| 3,170,516 | 2/1965 | Holland et al. | 166/192 |
| 3,647,000 | 3/1972 | Rowley et al. | 166/285 |
| 3,738,424 | 6/1973 | Osmun et al. | 166/302 |
| 3,861,690 | 1/1975 | Englesson et al. | 277/36 |
| 3,926,256 | 12/1975 | McCall | 166/285 |
| 4,116,285 | 9/1978 | Guerber | 175/7 |
| 4,133,383 | 1/1979 | Ely | 166/270 |
| 4,185,703 | 1/1980 | Guerber | 175/17 |
| 4,275,788 | 6/1981 | Sweatman | 166/292 |
| 4,369,845 | 1/1983 | Henson et al. | 166/292 |

OTHER PUBLICATIONS

"A Better Way to Kill Blowouts" by Taylor; Ocean Industry; Apr. 1971.

*Primary Examiner*—Stephen J. Novosad
*Assistant Examiner*—William P. Neuder
*Attorney, Agent, or Firm*—Alexander J. McKillop; Michael G. Gilman; Charles J. Speciale

[57] ABSTRACT

A method for controlling or terminating the flow of gas, oil or other fluids from an uncontrolled well penetrating a subterranean formation which comprises introducing into the active string metallic balls which melt at a temperature below that of the formation at the bottom end of the active casing or tubing string. Alternatively, liquid alloy is introduced into the active string which will cool and solidify in the well to form a plug of solid alloy in the string to stop the flow of fluid.

12 Claims, No Drawings

WELL CONTROL METHOD USING LOW-MELTING ALLOY METALS

FIELD AND BACKGROUND OF THE INVENTION

This invention relates generally to a method for controlling well blow outs, especially when those wells are located in a body of water and the well cannot be conventionally controlled using drilling mud.

The environmental hazards, as well as the hazards to personnel, of well blow outs have become increasingly important, especially where those blow outs have taken place in ecologically sensitive areas, such as the coast of California or off the Yucatan Peninsula of Mexico. As a result, the prior art is replete with disclosures of methods for controlling such blow outs. However, none of these methods is of universal application, and each poses some economic or technological drawback.

U.S. Pat. Nos. 4,116,285 and 4,185,703 disclose methods and apparatus for producing deep boreholes in which the borehole is filled at least partially with a substance which remains in the liquid state and has a density greater than the mean density of the ground strata being drilled. Thus, any infiltrations from the formation into the borehole, as well as drilling debris, naturally move upward to the free surface of the liquid substance filling the borehole. Various filling substances which are disclosed include antimony trichloride and other antimony, selenium and tellurium compounds, as well as silica gel, cryolite and metals having a low melting point. It is indicated in these patents that, as temperatures increase with increasing depth of borehole, solid pieces of metallic selenium and tellurium (which eventually melt near the bottom of the borehole) may be used as a substitute for or in conjunction with the more volatile liquid antimony and selenium compounds, which are used at the lower temperatures associated with holes up to about 4,500 meters in depth. In any case, the upward migration of debris and infiltrations into the borehole may be accelerated by circulating the liquid filling the borehole with a pump.

U.S. Pat. No. 3,647,000 discloses a method for capping the uncontrolled flow of oil and gas from petroleum wells located in a body of water by a procedure performed below the level of the water's surface in a location which is free from wave action and safe from the danger of fire or explosion. The method involves the tapping of a window or access opening into the well casing or tubing through which the well fluids are flowing below the surface of the well, crimping the casing or tubing above the point of the tap and injecting solid plugging bodies which lodge within the constriction in the production tubing string and form a plug blocking the flow. Heavy non-combustible mud is then pumped into the production tubing through the tapped-in access line until the weight of the injected mud overcomes the formation pressure, thus terminating well flow. Neither the nature of the plugging bodies nor the nature of the heavy mud is specified.

U.S. Pat. No. 3,926,256 discloses a method for preventing blow outs in offshore wells by providing the well with an apparatus in which pins extend into the passage through which oil or gas are flowing, the uncontrolled flow being stopped by the injection into the pin-containing region of a sealer material such as balls of rubber or fiber, natural or synthetic, Fiberglas, aluminum, shredded Teflon, and the like, followed by a mastic which acts as the sealing agent.

U.S. Pat. No. 4,133,383 discloses a method for terminating formation fluid blow outs by introducing into the formation a low viscosity fluid which has the property of becoming highly viscous under the influence of heat. Gelling and sealing agents, including hydratable polysaccharides that are cross-linkable under heat and pressure, are disclosed. The stability of the polysaccharides at temperatures above 300° F. is protected by the provision of an encapsulated base in the aqueous fluid through which the polysaccharides are introduced into the formation, the encapsulated base being released at about 300° F., thereby offsetting the degrading effect of the acids generated in the formation at that temperature.

It is also known to apply dry ice or liquid nitrogen to the exterior of the string through which the well is blowing out and thereby freeze the blowing fluids to form a plug in the string.

In another development, the casing string through which the Ixtox I well in the Gulf of Mexico was blowing out during the summer of 1979 was treated with some success in an effort to cut down the flow by pumping in iron and lead balls.

SUMMARY AND DETAILED DESCRIPTION OF THE INVENTION

The present invention is an improvement on the general technique employed in the Ixtox I blow out and renders this form of treatment much more effective by employing balls or liquid made of a low-melting alloy. Thus, the invention comprises a method for controlling or terminating the flow of gas, oil or other formation fluids from an uncontrolled well penetrating a subterranean formation, wherein an alloy material which melts at a temperature somewhat above the surface temperature but below that of the formation at the bottom end of the casing or tubing string of the well is introduced into the well, e.g. by "lubricating" it into the active casing or tubing string. The preferred alloys employed in the invention are those which melt well below the bottom hole temperature of the well, and, when applied to an uncontrolled well, melt and form a kind of drilling fluid or mud. Thus, the aggregation or bunching of the iron and lead balls experienced in the Ixtox I blow out is greatly alleviated. The density of the molten alloy portion of the fluid is in the range of about 75–80 lb./gallon, well above the 31 lb./gallon density of normal drilling muds.

One embodiment of the invention includes introducing metallic balls of low melting point into the well until the balls fill the well up to a point where the temperature of the formation is below the melting point of the balls. Thus, liquid alloy is pushed up into this zone, freezes around the non-molten balls in this cooler portion of the well and forms a complete alloy seal of the well.

In another embodiment of the invention the alloy may be injected into the active string as a liquid, adjusting its temperature and selecting its melting-freezing point so that the alloy becomes frozen as it passes up the active string to the surface. For example, a liquid coolant such as water or drilling mud can be introduced simultaneously with the liquid alloy. A plug in the string is thus formed utilizing the inherent lower temperature at the surface without need for a separate cooling means such as the difficult-to-apply dry ice and liquid nitrogen procedure formerly sometimes employed.

It will be recognized that, as a well flows, the temperature of the well at the surface will rise as the hotter fluids from the active zone reach the surface. In the Arun field in northern Sumatra, for example, the surface flow temperature of a gas well is about 315° F.—nearly the same as the bottom hole temperature. In this case it might be helpful or even necessary to inject a liquid coolant such as water or drilling mud with the liquid alloy in order to cool and freeze it. A separate line may be required for adding the coolant.

By altering their composition the melting points of the alloys can be tailored to the temperature of the formation. Alloys having melting points in the range of about 125°-450° F. or above, preferably about 125°-300° F., and more preferably about 135°-225° F., provide a liquid seal for most wells presently being drilled. The method of this invention is particularly adaptable to blow outs offshore where the alloy balls can be injected into the well at the sea floor, thus avoiding the dangers of fire or explosion, etc. at the surface.

To be effective the alloy balls, after being introduced into the active string, must settle down the string against the flow of fluids. It is therefore desirable to determine in advance the size of ball which will settle against the fluids flowing from the active string. A formula suitable for making this determination where gas is the flowing fluid is one employed to calculate the required gas velocity to lift cuttings from a well being drilled using gas. The formula states:

$$U^2 = \frac{2}{C_d} \frac{V}{A} g \left( \frac{\rho_p - \rho_f}{\rho_f} \right)^{1.03}$$

Where: $U$ = Terminal Velocity of Sandstone Particle (i.e. cutting) (f/sec)
$V$ = Volume of Particle ($ft^3$)
$A$ = Cross Sectional Area of Particle ($ft^2$)
$g$ = Acceleration of Gravity (32.2 $ft/s^2$)
$\rho_p$ = Density of Particle ($lb/ft^3$)
$\rho_f$ = Density of Gas or Air ($lb/ft^3$)
$C_d$ = Drag Coefficient From this formula or similar formulae well known to workers in the art, it can be determined at what velocity balls of a given density would settle in a well producing either gases and/or liquids.

Any of a variety of methods for introducing the balls or liquid e.g. the use of a gun or screw, the use of a directional and relief well, etc., will be readily apparent to workers in the art and can be employed to practice the invention.

In the case where the flow from the well is sufficiently fast to prevent settling of the balls, a restriction to flow, such as by crimping, can be employed to lower the flow to a point where the balls will settle.

If the flow cannot be slowed to the point where the balls will settle, then the balls may have to be applied through a relief or "kill" well which intersects the well bore of the wild well near its bottom. Note that applying the balls via a relief well is straight forward in that the relief well is controlled by a mud column. The balls could be poured into the top of the open well or carried by the mud being pumped into the bottom of the wild well to kill it. If open formations are exposed in the wild well, the well bore may be enlarged by erosion making it more difficult to kill. In this instance, the metal (either liquid or solid) will form a more resistant and effective barrier to flow than ordinary drilling mud.

The preferred method of introducing the balls or liquid is by means of a "hot-tap" into the active string. Two lubricators (heated preferably by a steam jacket, if liquid alloy is to be applied) are added by hot-tap so that the alloy material can be continuously fed into the pipe. The valves on these lubricators should best be remotely controlled. In the case where the lubricators are run to the supply ship, one valve is opened and the alloy permitted to be introduced into the well while simultaneously the other lubricator is being filled. The result is continuous addition of balls or liquid which leads to more prompt killing of the well.

Of course, heating means such as a steam jacket ordinarily would be employed only when liquid alloy is to be used. It might also be noted that one of the lubricators can be used as the means to inject coolant in the event coolant is found to be needed.

Of particular value in carrying out this invention as low-melting alloys are Lipowitz metal, Woods metal and Rose metal. The specifications of these materials are set forth in the following table:

TABLE I

| Name of Alloy | MP °C. | MP °F. | Bismuth | Lead | Tin | Cadmium | Specific Gravity | Density lb/gal |
|---|---|---|---|---|---|---|---|---|
| Lipowitz Metal | 60 | 140 | 50 | 27 | 13 | 10 | 9.05 | 75.4 |
| Woods Metal | 71 | 160 | 50 | 25 | 12.5 | 12.5 | 8.92 | 74.3 |
| Rose Metal | 94 | 201 | 50 | 27.1 | 22.9 | — | 9.65 | 80.4 |

Other low melting alloys, of course, can be used in the invention, provided they have the property of melting in the lower portion of the hole and freezing in the upper portion of the hole. The choice of such alloys based upon this disclosure is believed to be within the level of ordinary skill in the art.

The detailed summary and description of the invention provided above are set forth in accordance with the requirements of the Patent Act and are provided solely as illustration. It will be evident to persons of ordinary skill in this art upon reading this disclosure to modify this invention depending upon the requirements of the particular application. These modifications are within the scope and spirit of the invention and are intended to be covered in the claims appended hereto.

What is claimed is:

1. A method for controlling or terminating the flow of gas, oil or other fluids from an uncontrolled well penetrating a subterranean formation which comprises introducing into the active string low-melting metallic balls, and melting at least some of said metal balls at a temperature below that of the formation at the bottom end of the active casing or tubing string.

2. The method of claim 1 wherein said balls are introduced by hot-tapping into the active casing or tubing string.

3. The method of claim 2 wherein the introduction of said metallic balls is continued until the balls fill said well to a point where the temperature of the formation is below the melting point of said balls.

4. The method of claim 2 wherein the metallic balls comprise an alloy having a melting point at or below about 300° F.

5. The method of claim 4 wherein said alloy is selected from the group consisting of Lipowitz metal, Woods metal and Rose metal.

6. A method for controlling or terminating the flow of gas, oil or other fluids from an uncontrolled well penetrating a subterranean formation which comprises introducing into the active string liquid alloy which will cool and solidify in the well to thereby form a plug of solid alloy in the string to stop said flow.

7. The method of claim 6 wherein said liquid alloy is introduced by hot-tapping and a heated lubricator.

8. The method of claim 7 wherein said lubricator is heated by a steam jacket.

9. The method of claim 7 wherein said liquid alloy has a melting point at or below about 300° F.

10. The method of claim 9 wherein said alloy is selected from the group consisting of Lipowitz metal, Woods metal and Rose metal.

11. The method of claim 7 wherein the surface temperature is such as to cause solidification of said liquid alloy.

12. The method of claim 7 wherein a coolant is introduced to cause solidification of said liquid alloy.

* * * * *